United States Patent [19]
Rosbiegalle et al.
[11] 4,231,669
[45] Nov. 4, 1980

[54] DEVICE FOR RECEIVING A WRITING IMPLEMENT

[75] Inventors: Rudolf Rosbiegalle, Geroldsgruen; Karl Färber, Steinbach; Herbert Grimm; Helmut Schmeisser, both of Geroldsgruen; Hermann Schönhut, Stein; Svatopluk Krumnikl, Nuremberg; Günter Edel, Fürth, all of Fed. Rep. of Germany

[73] Assignee: A.W. Faber-Castell, Stein bei Nuremberg, Fed. Rep. of Germany

[21] Appl. No.: 965,918

[22] Filed: Dec. 4, 1978

[30] Foreign Application Priority Data

Dec. 19, 1977 [DE] Fed. Rep. of Germany ..... 2756505

[51] Int. Cl.[3] ..... B43K 5/12
[52] U.S. Cl. ..... 401/258; 401/194
[58] Field of Search ..... 401/131, 258, 259, 260, 401/194, 230, 132–135, 243–247

[56] References Cited

U.S. PATENT DOCUMENTS

| | | | |
|---|---|---|---|
| 3,475,103 | 10/1969 | Danjczek | 401/258 |
| 3,802,788 | 4/1974 | Danjczek | 401/258 X |
| 3,862,683 | 1/1975 | Koelichen | 401/260 X |
| 3,963,359 | 6/1976 | Anderka | 401/258 |
| 4,086,011 | 4/1978 | Kuparinen | 401/258 |

FOREIGN PATENT DOCUMENTS

| | | | |
|---|---|---|---|
| 2443836 | 4/1976 | Fed. Rep. of Germany | 401/258 |
| 1175893 | 1/1970 | United Kingdom | 401/259 |

*Primary Examiner*—Edward M. Coven
*Attorney, Agent, or Firm*—Michael J. Striker

[57] ABSTRACT

A device for receiving a writing implement has a housing, a resiliently yieldable sealing member in the housing and adapted to sealingly abut against a writing tubular member of the writing implement, and a wetting member in the housing and located in spaced relationship with a pressure-equalizing passage of the writing implement as well as communicating with the passage. The resiliently yieldable member may be composed of two axially movable balls which are received in a cylindrical portion of the housing and axially limited by two axially spaced collars. The cylindrical portion may be connected with a conical extension which, in turn, may be connected with a further cylindrical portion received in the receiving opening of the housing. These portions may be of one-piece with each other so as to form a one-piece insert member.

16 Claims, 1 Drawing Figure

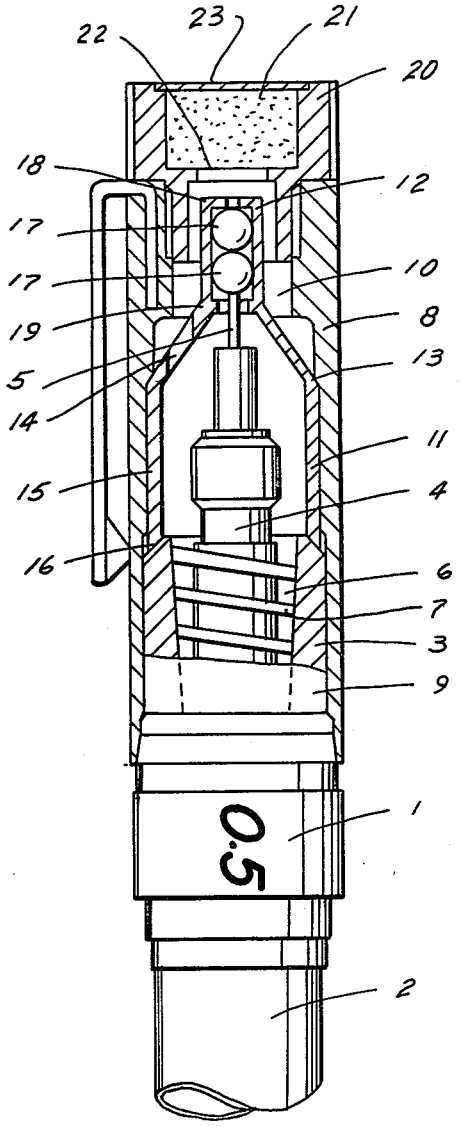
22
23
21
20
18
12
17
17
10
19
8
5
13
14
11
15
4
16
6
7
3
9
1
0.5
2

DEVICE FOR RECEIVING A WRITING IMPLEMENT

BACKGROUND OF THE INVENTION

The present invention relates to a device for receiving a writing implement which is filled by a writing liquid and has a pressure-equalizing passage formed between a writing insert and a head portion of the writing implement, the device having one or several openings each provided with a collar for mounting one or several wetting members.

When a writing implement has a tubular writing member and a cleaning needle longitudinally guided in the latter, drying must be prevented under all circumstances when the writing liquid is in communication with the outer air, to thereby guarantee an immediate start of the writing process. It is also necessary to maintain the pressure equalizing system of the writing implement in operative condition.

In order to attain these goals it is known to provide a separate sealing cap in a main cap of such a writing implement, the sealing cap accommodating a water impregnated cork member (German Gebrauchemuster No. 1,995,906). In such a construction a writing insert and an outlet of a pressure-equalizing passage is sealed from the outer air and, a zone of wet air is simultaneously generated in the region of a tubular writing member and in the pressure-equalizing passage of the writing implement. Thereby, the writing implement is ready to immediately start the writing process even after a long time of non-use. However, this construction possesses the disadvantage that the writing liquid at the front end of the writing tubular member becomes diluted, by the water, and for this reason the color of writing produced by the writing implement does not immediately have the degree of darkness which it is intended to have. Complete darkness of the ink can be obtained only after repeated making lines on a carrier (e.g. paper) with the writing tip.

It has been further proposed (German Gebrauchemuster No. 7,505,779) to provide in a protective cap a cup member serving to support a further cup-shaped extension against which the tubular writing member sealingly abuts and which simultaneously hermetically closes the outlet of the equalizing system. Since all parts of the writing implement which are in communication with the outer air are sealed, the writing implement is ready to immediately start the writing process. However, in this construction the pressure-equalizing system is rendered ineffective. Thus, pressure - and temperature fluctuations which act upon a container filled by writing liquid, cannot be equalized. A pressure differential which develops when the pressure-equalizing passage is unsealed results in discharging of the writing liquid and soiling of the writing tip.

SUMMARY OF THE INVENTION

Accordingly, it is an object of the present invention to provide a device for receiving a writing implement, which avoids the disadvantages of the prior art.

More particularly, it is an object of the present invention to provide a device for receiving a writing implement, which guarantees readiness to write of the writing implement in the sense of immediate capability of the latter to write, even after a long time of non-use.

It is another object of the present invention to provide a device for receiving a writing implement, which assures that when the writing implement is withdrawn from the device, it does not become soiled in the region of a pressure-equalizing passage and therefore also in the region of gripping the writing implement by the user irrespective of a degree to which a container of the writing implement is filled by a writing liquid.

In keeping with these objects and with others which will become apparent hereinafter, one feature of the present invention resides, briefly stated, in a device for receiving a writing implement, which has a resiliently yieldable member located in an inner chamber communicating with a receiving opening so that a tubular writing element of the writing implement sealingly abuts against the resiliently yieldable member, and an additional wetting member having at least one face which discharges a wetting medium and is spaced from as well as communicates with a pressure-equalizing passage of the writing implement. More particularly, the above-mentioned surface of the wetting member may communicate with an annular gap which is formed in housing means of the device and which, in turn, communicates with the pressure-equalizing passage.

Another feature of the present invention is that the resiliently yieldable sealing member may be composed of two balls which abut against each other and are movable in limited axial movement between two axially spaced collars. This compensates for positional tolerances in an axial direction of the device.

In accordance with still another feature of the present invention, in order to guarantee the axial movement of the resiliently yieldable member composed of two balls, the housing means may have inner and outer housing members, the former of which has a cylindrical leading end portion axially bounded by the above-mentioned two collars. The inner housing member may further include a conical extension portion connected with the cylindrical leading end portion and having a maximum diameter corresponding to the diameter of the receiving opening. Preferably, a trailing end cylindrical portion having a conical end section is further connected with the conical extension portion, and the above-mentioned three portions are of one piece with each other so as to form a one-piece insert member. Such a one-piece member provides for economical manufacture and easy mounting of the device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a view showing a section of a device in which a writing implement is received.

DESCRIPTION OF A PREFERRED EMBODIMENT

A writing implement to be received into a device in accordance with the present invention, has a head part 1 provided with a mark (here 0.5) indicating the line width to be produced by the implement. An ink tank or cartridge 2 is inserted into the head part 1 at one end of the latter. The other end of the head part 1 is formed as a mouthpiece 3 having a conical receiving opening. A writing insert 4 is received into the conical opening of the head part 1, and a tubular writing member 5 is provided at a leading end of the writing insert 4. A pressure-compensating passage 6 is formed when the writing insert 4 is inserted into the mouthpiece 3 with interposition of a screwthread-shaped coil 7.

The device for receiving the writing implement includes a cap 8 bounding an inner chamber 10 of a stepped cross section and having a receiving opening 9 communicating with the inner chamber. An insert 11 is inserted into the cap 8 and has a cylindrical leading end portion 12 merging into a conical extension portion 13. The conical extension portion 13 has a maximum outer diameter which corresponds to the diameter of the receiving opening 9. The conical extension portion 13 has a plurality of through-going openings 14.

In order to fix the insert member 11 in the cap 8 the former is provided with a trailing end portion 15 which has a conical end section 16 and is connected with the conical extension portion 13. The trailing end portion 15 is cylindrical and has an outer diameter corresponding to the diameter of the receiving opening 9 of the cap 8. The conical end section 16 of the trailing end portion 15 abuts against the head portion 1 of the writing implement.

A resiliently yieldable member composed of two resiliently yieldable balls 17 is further provided in the device. The balls 17 are located in the cylindrical leading end portion 12 of the insert member 11 and between two collars 18 and 19. The collars 18 and 19 are axially spaced from one another by a distance such as to permit certain axial movement of the balls 17.

The cap 8 and its end which is opposite to the receiving opening 9, terminates in an end part 20. The end part 20 serves for receiving an absorbent member 21 which has at least one face 22 facing toward the inner chamber 10. A cover 23 is provided for form-lockingly mounting the absorbent member 21 in the end part 20. The cover 23 may be secured to the end part 20 by glueing, welding or the like.

The device may be formed for receiving several such writing implements in which case it is provided with several resiliently yieldable members and several absorbent members.

The readiness of the writing implement to immediately write is attained in the device of the present invention, on the one hand, by hermetical abutment of the tubular writing member 5 which is somewhat embedded into the resiliently yieldable member 17, and, on the other hand, by prevention of drying of the ink in the pressure-compensating passage 6 under the action of the zone of wet air generated near the outlet of the passage. Moreover, the sealing engagement of the conical section 16 of the insert 11 with the mouthpiece 3 results in that both above-mentioned goals are attained to the complete degree.

The inner chamber 10 which is in communication with the pressure-compensating passage 6 through the through-going openings 14 also prevents building of a pressure in the pressure-compensating passage 6 which pressure can, otherwise, take place under the action of pressure and temperature fluctuations when the cap 8 is removed and suction is generated in the passage. Thereby, soiling of the writing insert is prevented.

It will be understood that each of the elements described above, or two or more together, may also find a useful application in other types of constructions differing from the types described above.

While the invention has been illustrated and described as embodied in a device for receiving a writing implement, it is not intended to be limited to the details shown, since various modifications and structural changes may be made without departing in any way from the spirit of the present invention.

Without further analysis, the foregoing will so full reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for receiving a writing implement having a body portion, and writing insert which together with said body portion bounds a pressure-equalizing passage and has a tubular writing member, the device comprising housing means bounding an inner chamber and having an opening arranged for receiving the body portion of the writing implement and communicating with said inner chamber; a resiliently yieldable sealing member is said inner chamber of said housing means and located so that the tubular writing member sealingly abuts against said sealing member; and a wetting member in said housing means and having at least one surface which discharges a wetting medium, said surface of said wetting member being spaced from and in communication with the pressure-equalizing passage of the writing implement when the latter is inserted in the device, so that a zone of wet air is generated in the region of said pressure-equalizing passage whereby drying of a writing liquid in the latter is prevented, but at the same time the tubular writing member is sealed by said resiliently yieldable sealing member from wet air thereby dilution of the writing liquid in the writing tubular member is prevented.

2. A device as defined in claim 1, wherein said housing means has a collar portion, said wetting member being absorbent and mounted in said collar portion.

3. A device as defined in claim 1, wherein said inner chamber bounded by said housing means has a leading portion, as considered in the direction of insertion of the writing implement, said leading portion being formed as an annular gap which communicates with the pressure-equalizing passage of the writing implement when the latter is inserted in the device, said surface of said wetting member communicating with said annular gap.

4. A device as defined in claim 1, wherein said sealing member is formed by two resiliently yieldable balls abutting against each other.

5. A device as defined in claim 4, wherein said housing means has an axis and two axially spaced collars bounding a hollow therebetween, said balls being located in said hollow bounded by said collars and movable in axial movement which is axially limited by said collars.

6. A device as defined in claim 5, wherein said housing means has an outer housing member bounding said inner chamber and having said receiving opening, and an inner housing member received in said outer housing member, said inner housing member having a leading end portion, as considered in the direction of insertion of the writing implement into the device, said leading end portion of said housing member being cylindrical and axially bounded by said collars.

7. A device as defined in claim 6, wherein said outer housing member has a wall bounding said receiving opening, said inner housing member further having an extension portion which is connected with said cylindrical leading end portion at a trailing end of the latter and has an outer diameter corresponding to the diameter of said receiving opening of said outer housing member.

8. A device as defined in claim 7, wherein said extension portion is conical.

9. A device as defined in claim 8, wherein said inner housing member further includes a cylindrical trailing end portion connected with said conical extension portion at a trailing end of the latter and circumferentially abutting against said wall of said outer housing member.

10. A device as defined in claim 9, wherein said trailing end portion of said inner housing member has a trailing end spaced from said extension portion and a conical trailing end section at said trailing end.

11. A device as defined in claim 10, wherein said conical trailing end section is arranged to abut against the body portion of the writing implement when the latter is inserted in the device.

12. A device as defined in claim 10, wherein said leading end portion, said extension portion and said trailing end portion are of one piece with each other and forms a one-piece member insertable into said outer housing member.

13. A device as defined in claim 8, wherein said conical extension portion is provided with a plurality of through-going openings.

14. A device as defined in claim 13, wherein said housing means bounds an interior hollow formed inwardly of said inner housing member and communicating with the pressure-equalizing passage of the writing implement in the inserted position of the latter, and an exterior hollow formed between said inner housing member and said outer housing member, said through-going openings communicating said exterior hollow with said interior hollow.

15. A device as defined in claim 14, wherein said housing means has a leading end, as considered in the direction of insertion of the writing implement, and a bottom portion at said leading end, said wetting member being mounted in said bottom portion of said housing means.

16. A device as defined in claim 15, wherein said wetting member mounted in said bottom portion is located outwardly of said through-going openings so as to be in communication with said exterior hollow of said housing means.

* * * * *